US007845962B2

(12) United States Patent
Chung et al.

(10) Patent No.: US 7,845,962 B2
(45) Date of Patent: Dec. 7, 2010

(54) AFT-LIFT ELECTRIC CONNECTOR FOR A FLEXIBLE CIRCUIT BOARD

(75) Inventors: Yi-Hsing Chung, Wugu Township, Taipei County (TW); Sung-Tien Lin, Wugu Township, Taipei County (TW)

(73) Assignee: Taiwan Suncagey Industrial Co., Ltd., Taipei County (TW)

( * ) Notice: Subject to any disclaimer, the term of this patent is extended or adjusted under 35 U.S.C. 154(b) by 0 days.

(21) Appl. No.: 12/607,770

(22) Filed: Oct. 28, 2009

(65) Prior Publication Data

US 2010/0130051 A1 May 27, 2010

(30) Foreign Application Priority Data

Nov. 21, 2008 (TW) ..... 97220892 U

(51) Int. Cl.
*H01R 13/15* (2006.01)

(52) U.S. Cl. ..... 439/260; 439/495

(58) Field of Classification Search ..... 439/260, 439/495

See application file for complete search history.

(56) References Cited

U.S. PATENT DOCUMENTS

| | | | | |
|---|---|---|---|---|
| 7,347,720 | B2 * | 3/2008 | Takashita | 439/495 |
| 7,452,227 | B2 * | 11/2008 | Matoba et al. | 439/260 |
| 7,467,962 | B2 * | 12/2008 | Sunaga | 439/260 |
| 7,530,831 | B2 * | 5/2009 | Nishimatsu et al. | 439/260 |
| 7,601,017 | B2 * | 10/2009 | Wang et al. | 439/260 |

* cited by examiner

*Primary Examiner*—Thanh-Tam T Le
(74) *Attorney, Agent, or Firm*—Leong C. Lei

(57) ABSTRACT

The present invention discloses an aft-lift electric connector for a flexible circuit board. The electric connector includes a housing, a terminal and a pressing element. As a fixed arm is formed with a flange and a side edge of the pressing element is formed with a first notch and a second notch to accommodate the flange, therefore, before the electric connector operates, the first notch of the pressing element can be latched with the flange of the pushed part, so as to achieve a pre-operational positioning effect. On the other hand, after the electric connector has operated, the second notch of the pressing element can be latched with the flange of the pushed part, so as to achieve a post-operational positioning effect, allowing a user to verify that the electric connector has accomplished the pre-determined pushing operation.

3 Claims, 9 Drawing Sheets

AFT-LIFT ELECTRIC CONNECTOR FOR A FLEXIBLE CIRCUIT BOARD

BACKGROUND OF THE INVENTION a) Field of the Invention

The present invention relates to an electric connector, and more particularly to an aft-lift electric connector which is used for a flexible circuit board and is provided with a positioning function.

b) Description of the Prior Art

To enable a flexible circuit board achieving an electric connection effect, usually this kind of flexible circuit board will be connected to an electric connector which includes a housing, a terminal and a pressing element. When the pressing element of the electric connector is operated, the pressing element can operate the terminal, allowing the terminal to be pressed onto the flexible circuit board.

Referring to FIG. 1 and FIG. 2, it shows a first and second schematic view of an implementation of a conventional electric connector. As shown in the drawings, a conventional electric connector 1 includes a housing 11, a terminal 12 and a pressing element 13. The terminal 12 includes a fixed arm 121 and a movable arm 122 which are extended toward a same direction and are parallel provided. The fixed arm 121 is fixed on the housing 11, an end of the movable arm 122 is provided with a pushing part 123 and the other end is provided with a pushed part 124. The fixed arm 121 and the movable arm 122 are connected as one unit using a connection part 125, and the pressing element 13 is provided with a cam 131.

When a flexible circuit board 14 is inserted into the electric connector 1, a force is exerted to the pressing element 13, such that the pressing element 13 will be displaced toward a predetermined direction. The cam 131 of the pressing element 13 will then push upward the pushed part 124 and the movable arm 122 will make an angular displacement with the connection part 125 as a pivot, allowing the pushing part 123 to push the flexible circuit board 14. As a result, the terminal 12 can be electrically connected to the flexible circuit board 14.

However, when the aforementioned electric connector 1 is used, following issues and shortcomings actually exist to be improved:

1. The conventional electric connector 1 utilizes rotation of the cam 131 of the pressing element 13, further allowing the pushing part 123 of the movable arm 122 to push the flexible circuit board 14. Yet, before the electric connector 1 operates, a user may touch the pressing element 13 by a mistake, allowing the electric connector 1 to malfunction.
2. The conventional electric connector 1 utilizes the rotation of the cam 131 of the pressing element 13, further allowing the pushing part 123 of the movable arm 122 to push the flexible circuit board 14. However, after the electric connector 1 has operated, the user is unable to know whether the pushing part 123 has actually pushed the flexible circuit board 14 and accomplished the electric connection.

SUMMARY OF THE INVENTION

An electric connector of the present invention which allows a flexible circuit board to be connected electrically includes a housing, a terminal and a pressing element. The terminal is provided with a movable arm and a fixed arm which are extended toward a same direction and are parallel provided. An end of the movable arm is provided with a pushing part and the other end is provided with a pushed part. The fixed arm is fixed using the housing and the fixed arm is formed with a flange at an end close to the pushed part; whereas, the fixed arm is formed with an abutting edge at a location close to the flange. In addition, the movable arm and the fixed arm form a component by a connection part, the pressing element is provided with an abutting part which can push the pushed part, and a side edge of the pressing element is formed respectively with a first notch and a second notch to accommodate the flange.

The primary object of the present invention is to provide an aft-lift electric connector for a flexible circuit board, wherein as the fixed arm is formed with the flange at the end close to the pushed part, and the side edge of the pressing element is formed with the first notch to accommodate the flange, therefore, before the electric connector operates, the first notch of the pressing element can be latched with the flange of the pushed part, such that a pre-operational positioning effect can be accomplished effectively, which further avoids a malfunction by operating the electric connector. By the aforementioned technologies, the issue existing in the conventional electric connector that the pre-operational positioning effect cannot be achieved can be solved, thereby achieving the practical progressiveness of the pre-operational positioning function.

Another object of the present invention is to provide an aft-lift electric connector for a flexible circuit board, wherein as the fixed arm is formed with the flange at the end close to the pushed part, and the side edge of the pressing element is formed with the second notch to accommodate the flange, therefore, after the electric connector has operated, the second notch of the pressing element can be latched with the flange of the pushed part, such that the user can verify that the pressing element has accomplished the pre-determined pressing operation, which avoids the malfunction by operating the electric connector. By the aforementioned technologies, the issue existing in the conventional electric connector that the post-operational positioning effect cannot be achieved can be solved, thereby achieving the practical progressiveness of the post-operational positioning function.

To enable a further understanding of the said objectives and the technological methods of the invention herein, the brief description of the drawings below is followed by the detailed description of the preferred embodiments.

DETAILED DESCRIPTION OF THE PREFERRED EMBODIMENTS

Figure 1:
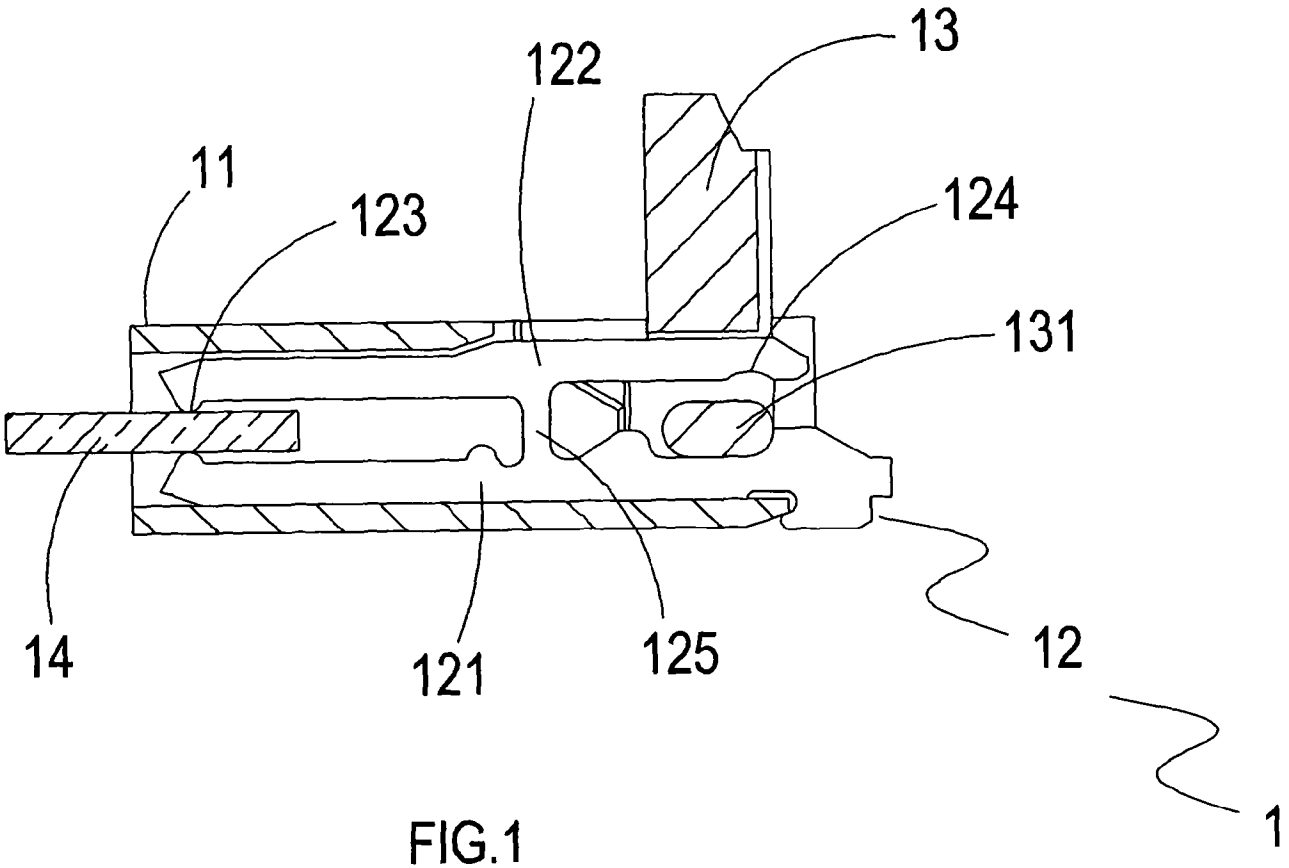
FIG.1 Prior Art
FIG. 1 shows a first schematic view of an implementation of a conventional electric connector.
Figure 2:
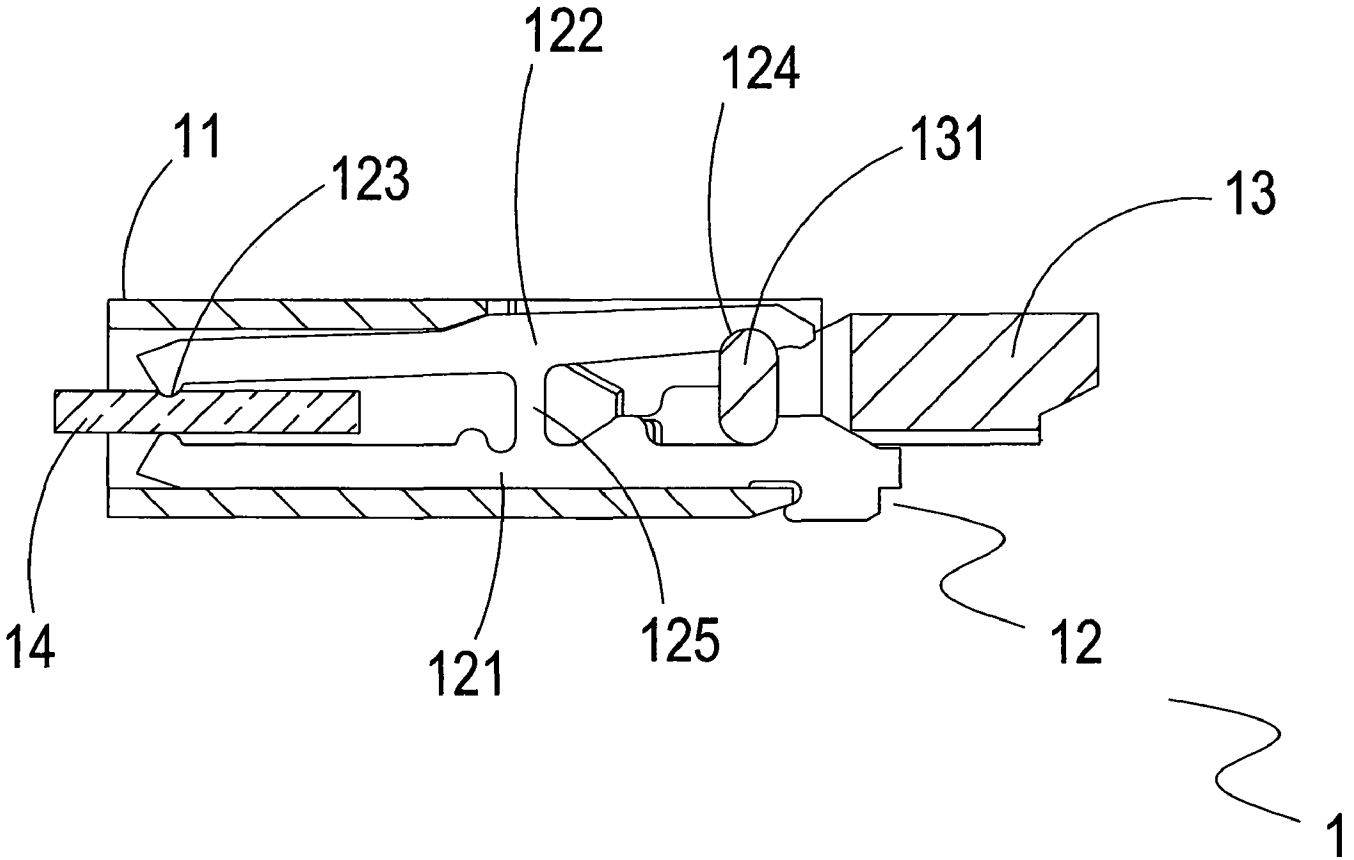
FIG.2 Prior Art
FIG. 2 shows a second schematic view of the implementation of the conventional electric connector.
Figure 3:
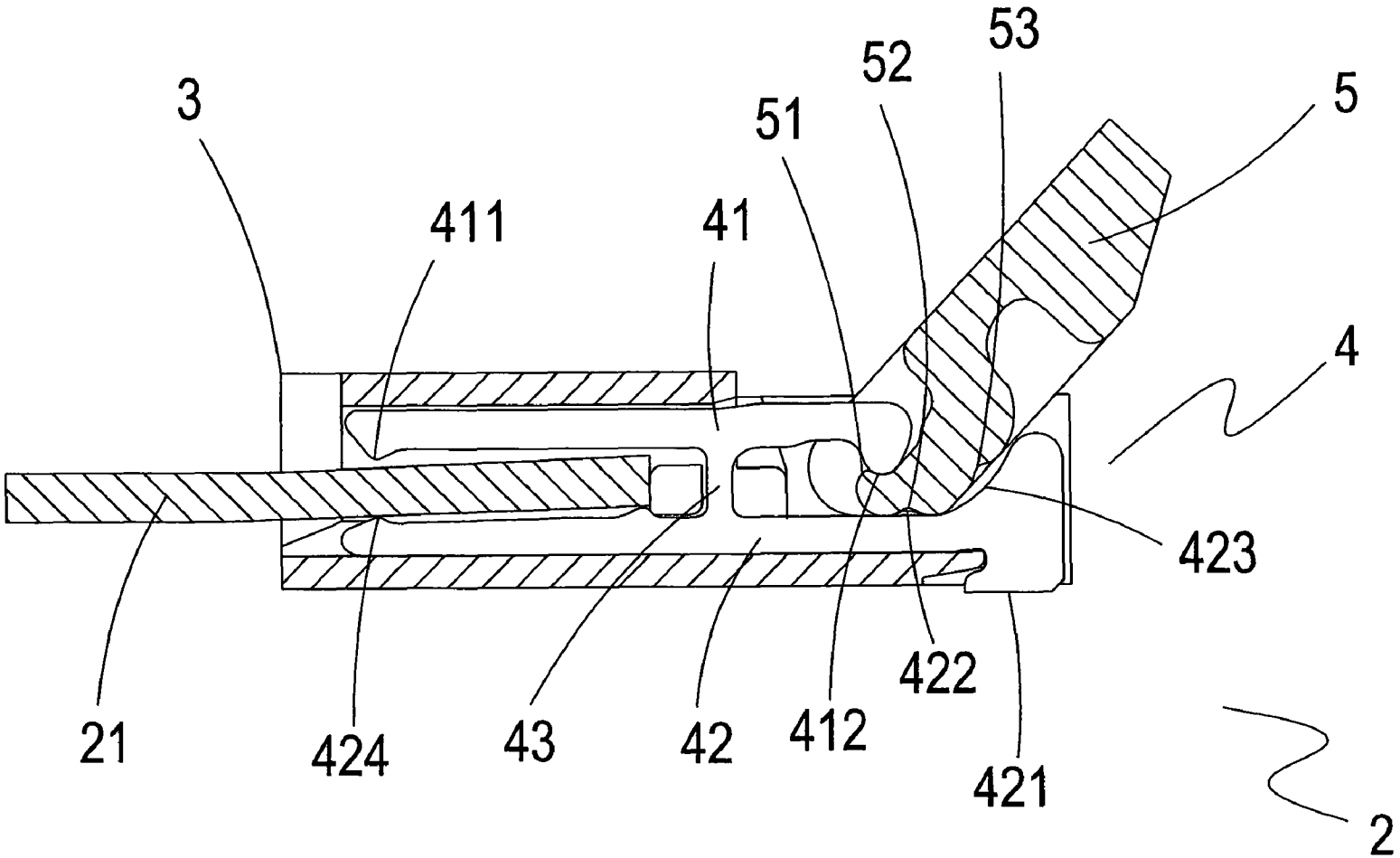
FIG. 3 shows a cross-sectional view of a preferred embodiment of the present invention.

Referring to FIG. 3, it shows a cross-sectional view of a preferred embodiment of the present invention. As shown in the drawing, an electric connector 2 of the present invention comprises:

a housing 3;

a terminal 4 which is provided with a movable arm 41 and a fixed arm 42, with both arms being extended toward a same direction and parallel provided, wherein an end of the movable arm 41 is provided with a pushing part 411, the other end is provided with a pushed part 412, the fixed arm 42 is fixed at the housing 3 using a fixing end 421 at an end, the fixed arm 42 is formed with a flange 422 at an end close to the pushed part 412, the fixed arm 42 is formed with an abutting edge 423 at a location close to the flange 422, the fixed arm 42 is formed with a latching part 424 at a location corresponding to the pushing part 411, and the movable arm 41 and the fixed arm 42 form a component by a connection part 43;

a pressing element 5 which is provided with an abutting part 51 to push the pushed part 412 and a side edge of which is formed respectively with a first notch 52 and a second notch 53 to accommodate the flange 422.

Figure 4:
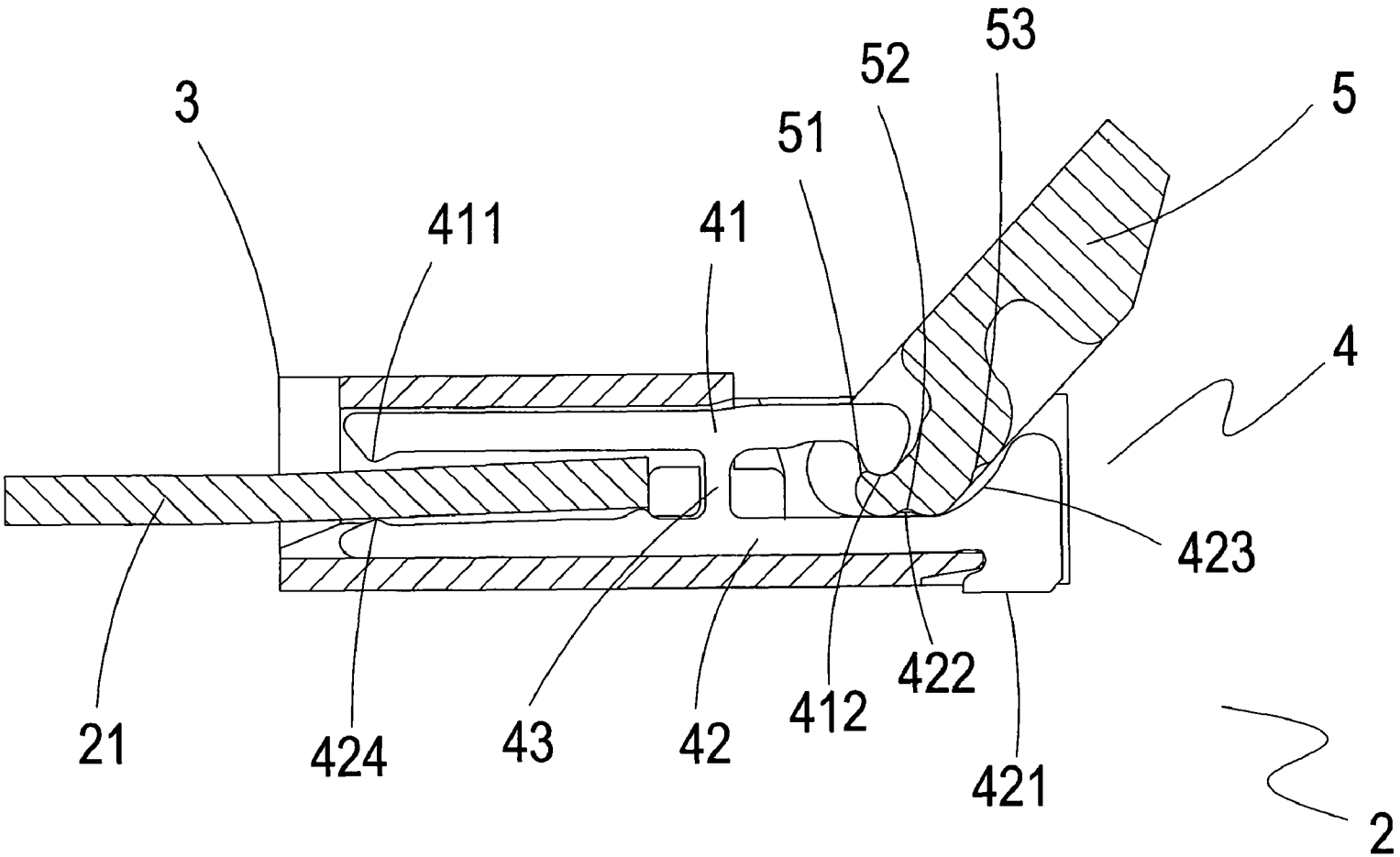
FIG. 4 shows a first schematic view of an implementation of the preferred embodiment of the present invention.

Referring to FIGS. 4 to 9, it shows a first to sixth schematic views of an implementation of the preferred embodiment of the present invention. As shown in the drawings, the electric connector 2 of the present invention allows a flexible circuit board 21 to be connected electrically. As shown in FIG. 4, before the electric connector 2 operates, as the fixed arm 42 is formed with the flange 422 at the end close to the pushed part 412, and the side edge of the pressing element 5 is formed with the first notch 52 to accommodate the flange 422, therefore, the pressing element 5 can effectively utilize the first notch 52 to position at the flange 422 of the fixed arm 42, thereby preventing the user from touching the pressing element 5 by a mistake, allowing the electric connector 2 to malfunction, prior to the operation of the electric connector 2. As a result, the practical progressiveness of a pre-operational positioning function is achieved.

When the flexible circuit board 21 is put into the housing 3 for electric connection, a force is exerted to the pressing element 5, enabling the pressing element 5 to be displaced toward a pre-determined direction. The abutting part 51 of the pressing element 5 can then push the pushed part 412 of the movable arm 41, allowing the movable arm 41 to make an angular displacement with the connection part 43 as a pivot, such that the flexible circuit board 21 can be pushed by the pushing part 411 of the movable arm 41.

Figure 5:
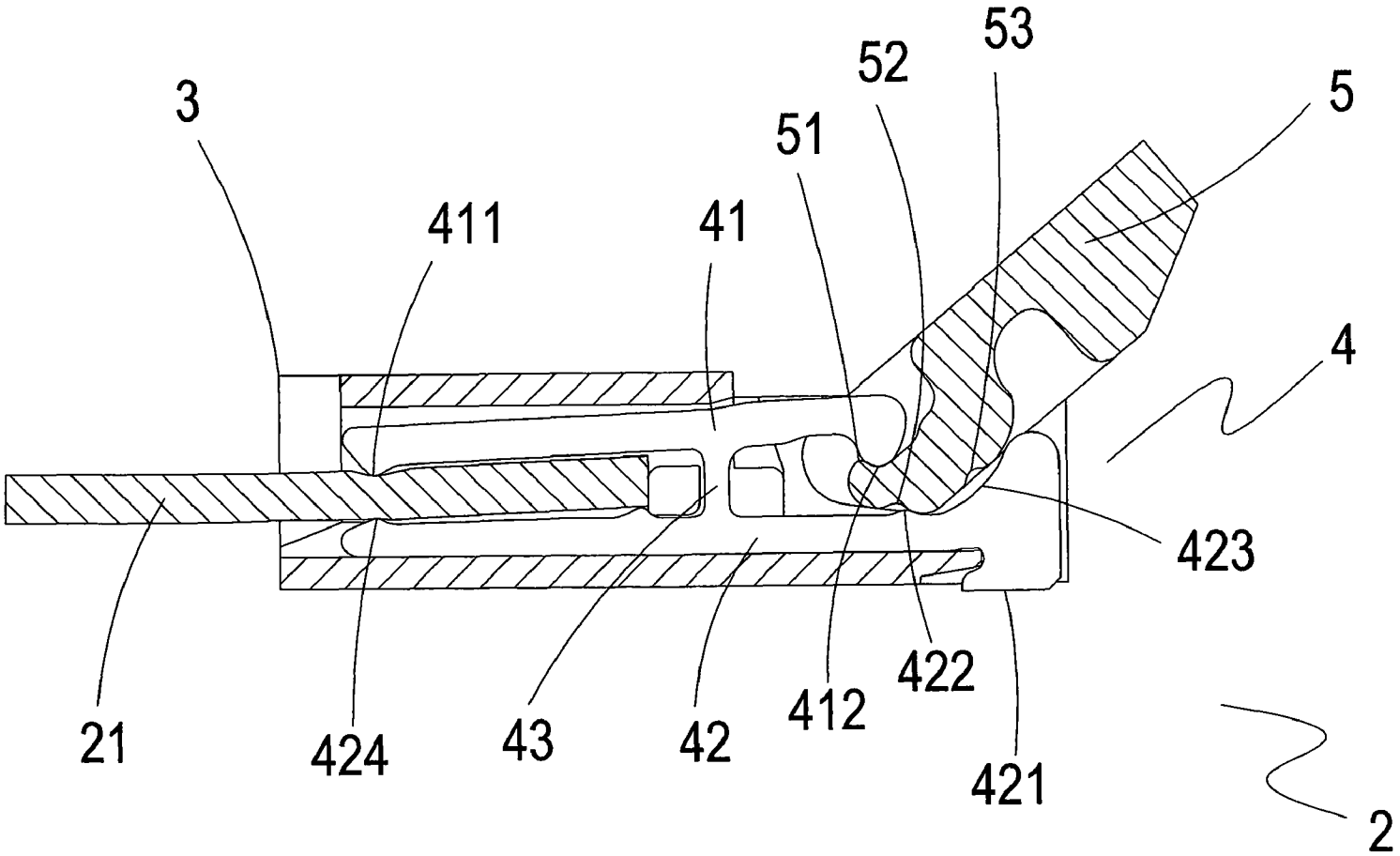
FIG. 5 shows a second schematic view of the implementation of the preferred embodiment of the present invention.
Figure 6:
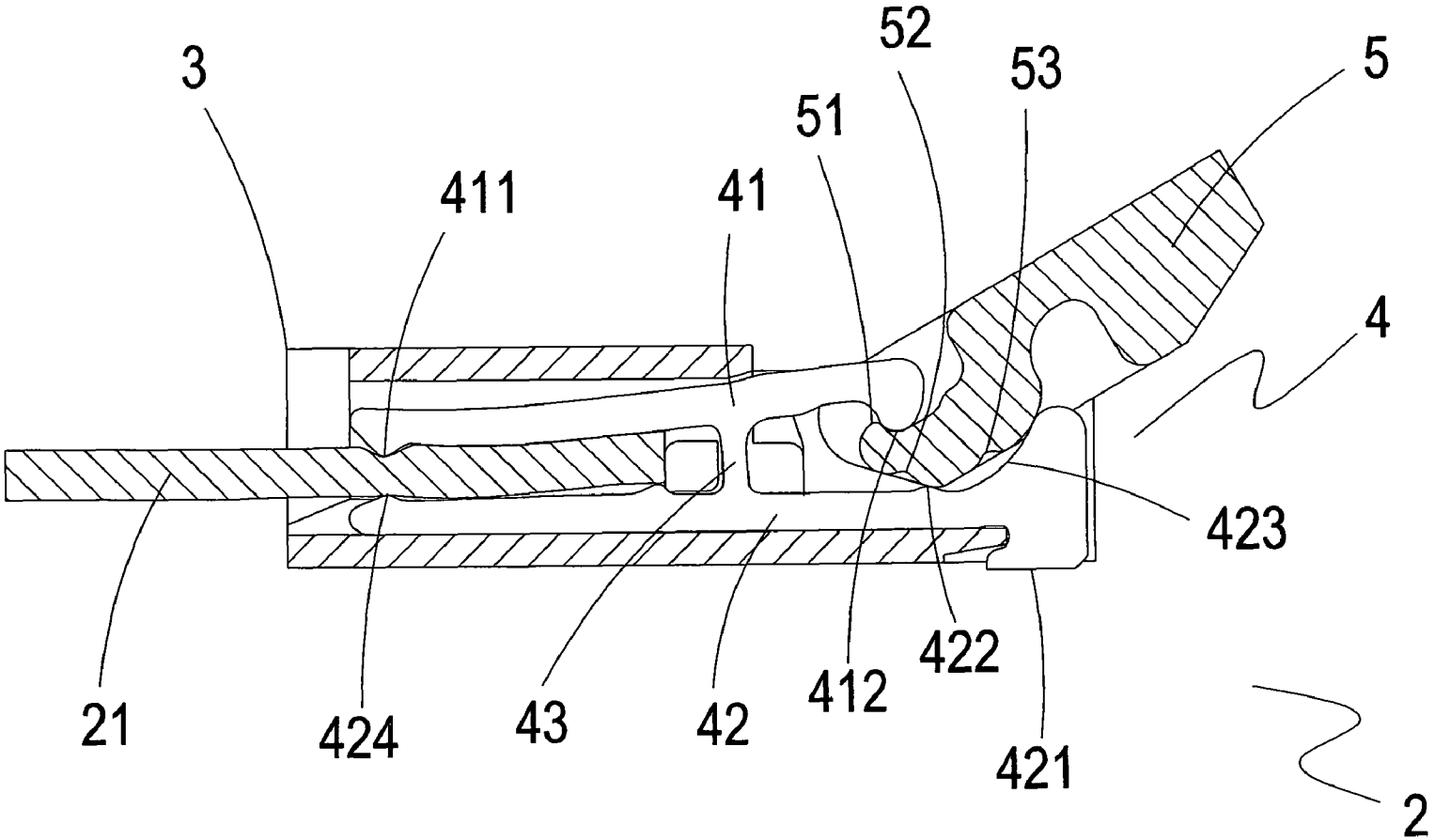
FIG. 6 shows a third schematic view of the implementation of the preferred embodiment of the present invention.
Figure 7:
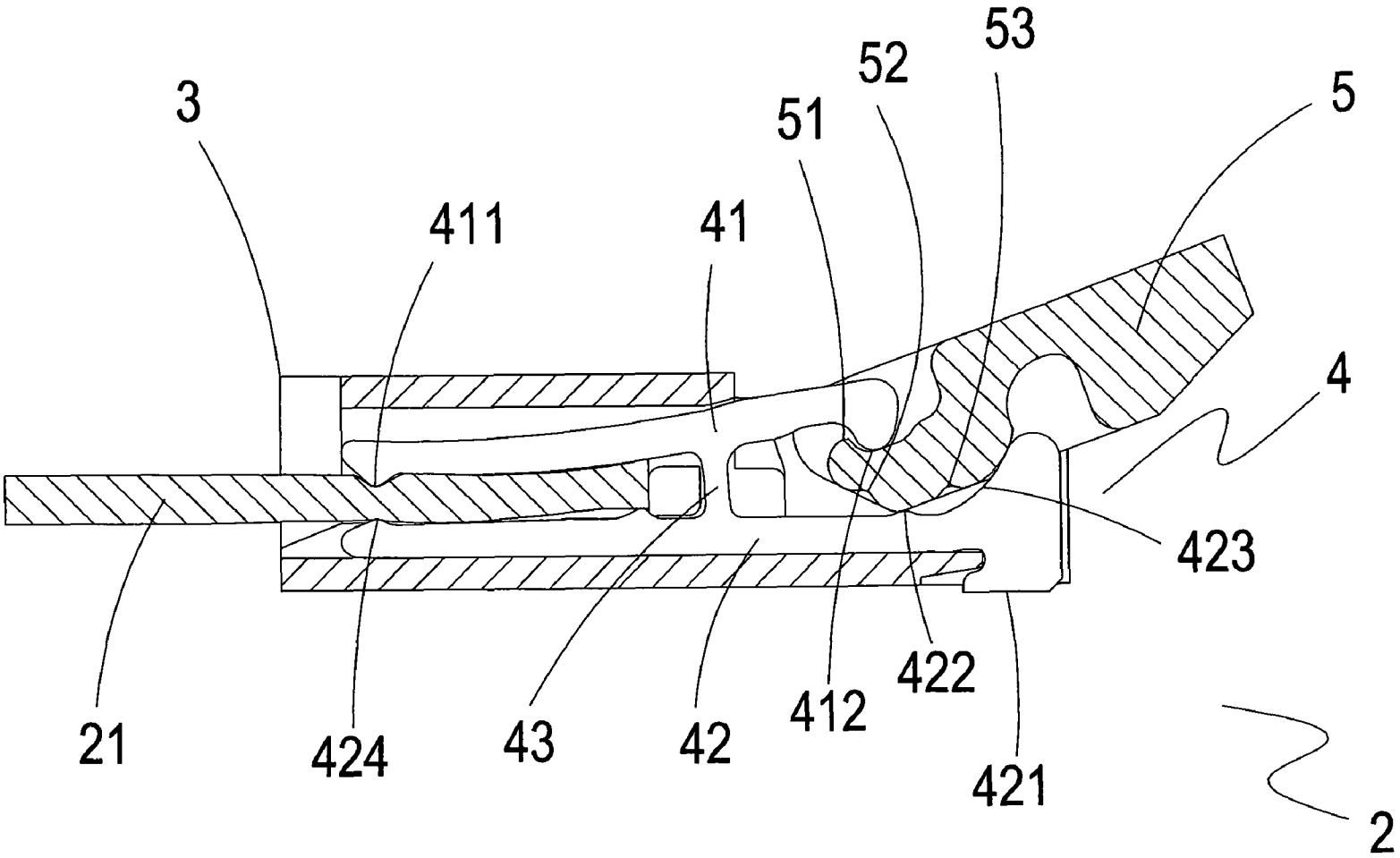
FIG. 7 shows a fourth schematic view of the implementation of the preferred embodiment of the present invention.

As shown in FIG. 5, when the pressing element 5 is exerted by the force and is making the angular displacement with the connection part 43 as the pivot, the first notch 52 of the pressing element 5 will escape from the flange 422 due to the displacement of the pressing element 5. As shown in FIG. 6, as the first notch 52 escapes from the flange 422, the flange 422 will force the pressing element 5 to form an upward pushing force and in a mean time, the abutting part 51 of the pressing element 5 will push the pushed part 412 of the movable arm 41 by the upward pushing force, allowing the pushed part 412 of the movable arm 41 to be hooked upward. As shown in FIG. 7, as the abutting part 51 of the pressing element 5 continues using the upward pushing force to hook the pushed part 412 of the movable arm 41, the pushed part 412 of the movable arm 41 will be lifted upward effectively, such that the movable arm 41 can make an angular displacement with the connection part 43 as the pivot, which further allows the pushing part 411 of the movable arm 41 to push the flexible circuit board 21.

Figure 8:
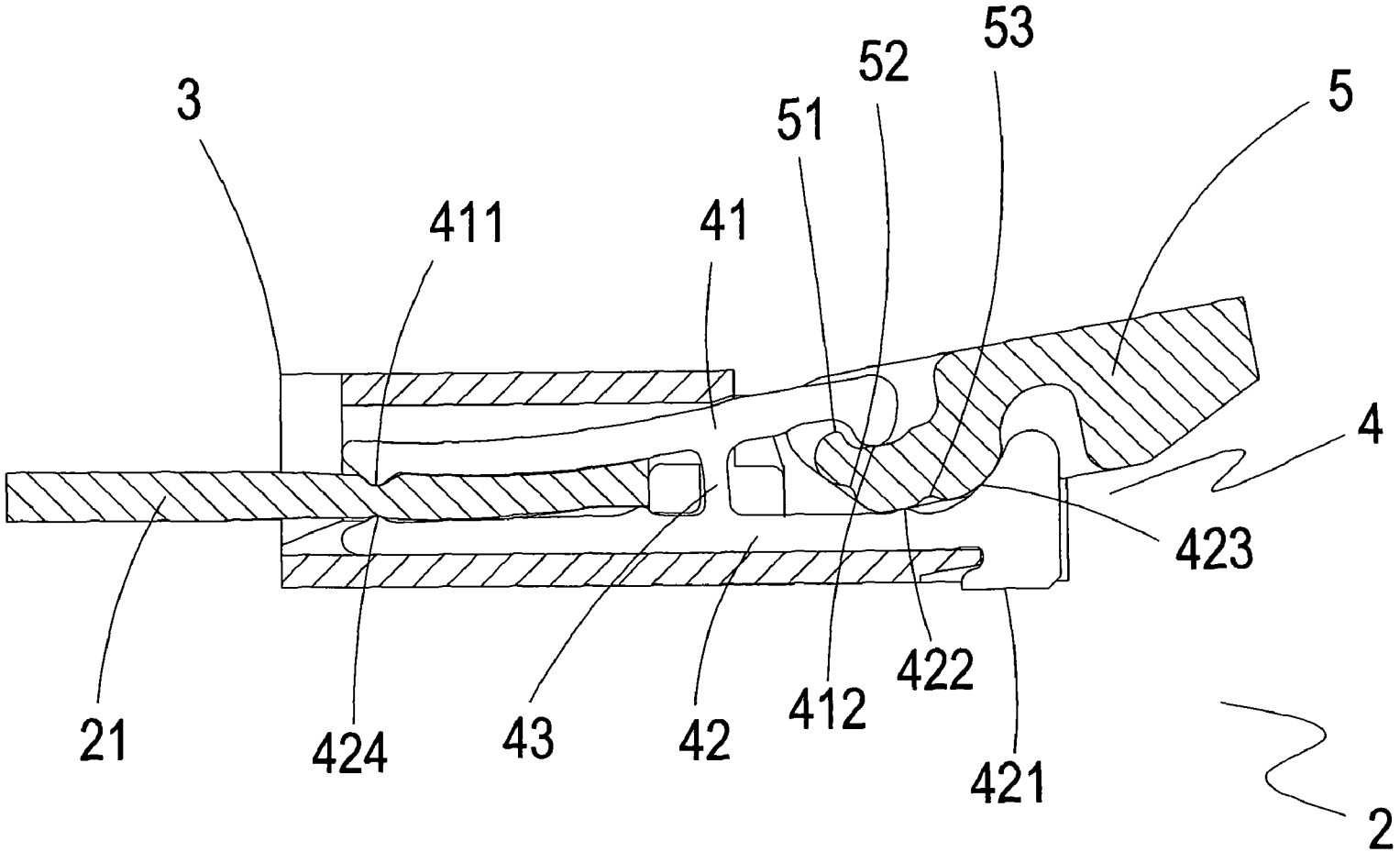
FIG. 8 shows a fifth schematic view of the implementation of the preferred embodiment of the present invention.
Figure 9:
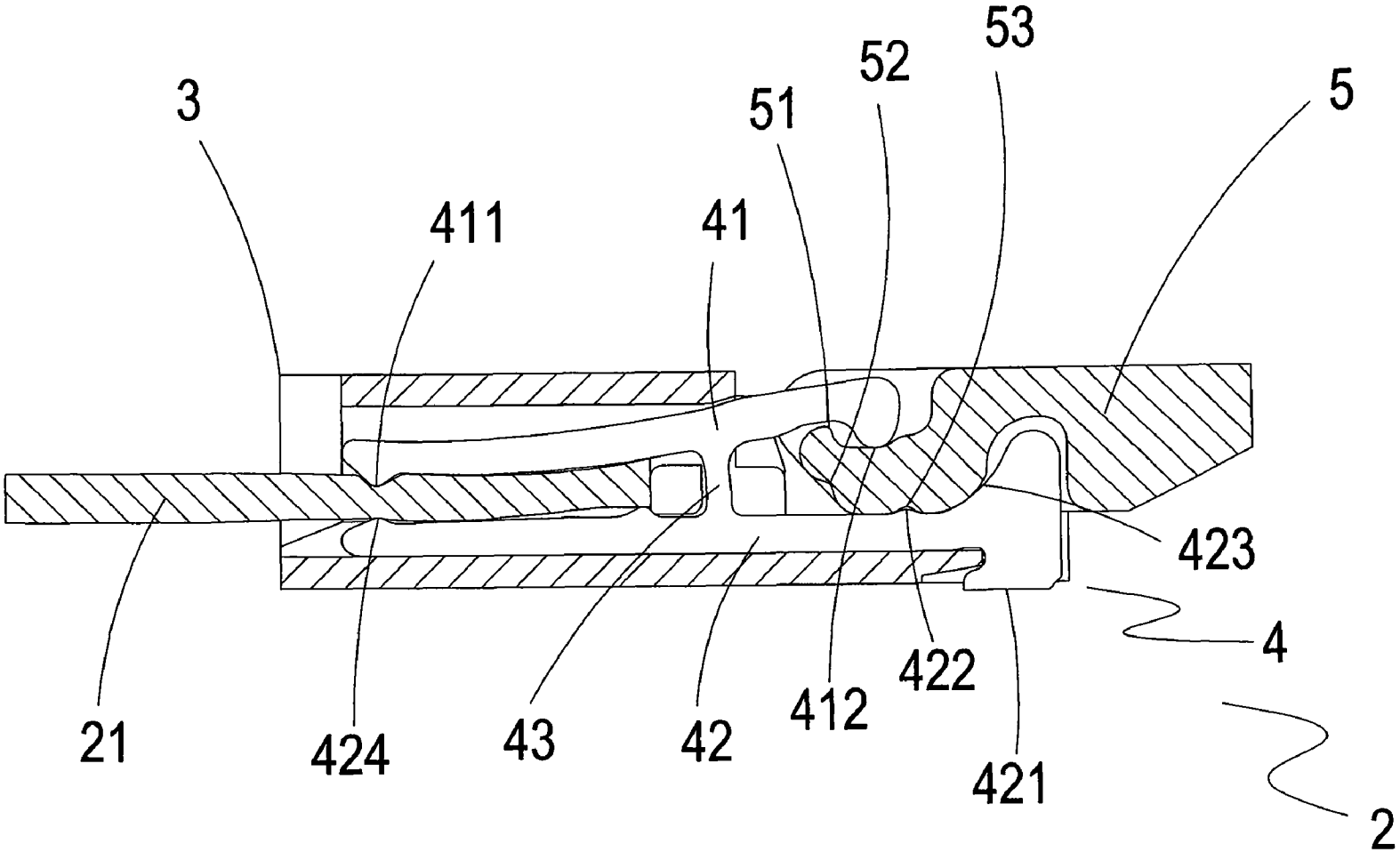
FIG. 9 shows a sixth schematic view of the implementation of the preferred embodiment of the present invention.

As shown in FIG. 8, after the pushed part 412 of the movable arm 41 has been effectively lifted upward, as the fixed arm 42 is formed with the abutting edge 423 at a location close to the flange 422, therefore, the abutting edge 423 can push the pressing element 5 to slide into the housing 3. As shown in FIG. 9, as the abutting edge 423 pushes the pressing element 5 to slide into the housing 3, and the pressing element 5 is formed with the second notch 53 at the side edge close to the first notch 52 in order to accommodate the flange 422, the second notch 53 can be latched with the flange 422 of the fixed arm 42. When the second notch 53 is completely latched with the flange 422, the electric connection of the flexible circuit board 21 is accomplished. By the aforementioned structures, the electric connector of the present invention is further provided with a post-operational positioning effect, with that the user can effectively verify that the pressing element 5 has accomplished the pre-determined pressing operation, thereby avoiding malfunction to damage the electric connector 2.

Accordingly, referring to all the drawings, the present invention is indeed provided with following advantages in comparison with the prior art.

The fixed arm 42 of the electric connector 2 is formed with the flange 422 at the end close to the pushed part 412, and the side edge of the pressing element 5 is formed with the first notch 52 to accommodate the flange 422. Before the electric connector 2 operates, the first notch 52 of the pressing element 5 can be latched with the flange 422 of the pushed part 412, which is provided with the pre-operational positioning effect. On the other hand, as the side edge of the pressing element 5 is formed with the second notch 53 to accommodate the flange 422, after the electric connector 2 has operated, the second notch 53 of the pressing element 5 can be latched with the flange 422 of the pushed part 412 and the user can effectively verify that the pressing element 5 has accomplished the pre-determined pressing operation. As a result, the electric connector 2 of the present invention is provided with the pre-operational and post-operational positioning effects, wherein, before operation, the user can be prevented from touching the electric connector 2 by a mistake, causing the electric connector 2 to malfunction; on the other hand, after operation, the user can effectively verify that the electric connector 2 has accomplished the pre-determined pushing operation, thereby preventing the user from pressing the pressing element 5 continuously to damage the electric connector 2. Accordingly, the practical progressiveness of the pre-operational and post-operational positioning effects of the electric connector 2 is achieved.

It is of course to be understood that the embodiments described herein is merely illustrative of the principles of the invention and that a wide variety of modifications thereto may be effected by persons skilled in the art without departing from the spirit and scope of the invention as set forth in the following claims.

What is claimed is:

1. An aft-lift electric connector for a flexible circuit board, the electric connector providing a pre-determined flexible circuit board for electric connection and comprising: a housing; a terminal which is provided with a movable arm and a fixed arm, the movable arm and the fixed arm being extended toward a same direction and parallel provided, wherein an end of the movable arm is provided with a pushing part, the other end is provided with a pushed part, the fixed arm is fixed by the housing, the fixed arm is formed with a flange at an end close to the pushed part, the fixed arm is formed with an abutting edge at a location close to the flange, and the movable arm and the fixed arm form a component by a connection part; and a pressing element which is provided with an abutting part to push the pushed part and a side edge of which is formed respectively with a first notch and a second notch to accommodate the flange; when the pressing element is exerted by a force to be displaced toward a pre-determined direction, the abutting part of the pressing element pushing the pushed part of the movable arm, allowing the movable arm to make an angular displacement with the connection part as a pivot, such that the flexible circuit board is pushed by the pushing part of the movable arm.

2. The aft-lift electric connector for a flexible circuit board, according to claim 1, wherein the fixed arm is formed with a fixing end at a position where the fixed arm is fixed at the housing.

3. The aft-lift electric connector for a flexible circuit board, according to claim 1, wherein the fixed arm is formed with a latching part at a position corresponding to the pushing part.

* * * * *